United States Patent [19]

Login et al.

[11] 4,198,464

[45] Apr. 15, 1980

[54] FIBER LUBRICANTS BASED UPON ETHYLENE OXIDE CAPPED POLYETHERS OF TETRAHYDROFURAN AND ETHYLENE OXIDE

[75] Inventors: Robert B. Login, Woodhaven; William K. Langdon, Grosse Ile; Ronald L. Camp, Riverview, all of Mich.

[73] Assignee: BASF Wyandotte Corporation, Wyandotte, Mich.

[21] Appl. No.: 909,879

[22] Filed: May 26, 1978

[51] Int. Cl.[2] ..... D02G 3/36

[52] U.S. Cl. ..... 428/361; 252/8.9; 427/393.5; 427/389.9; 427/424; 427/434.6; 428/413

[58] Field of Search ..... 252/8.9; 427/385 B, 427/445, 222, 390 R, 424, 434 D; 428/413, 361; 8/115.6

[56] References Cited

U.S. PATENT DOCUMENTS

| | | | |
|---|---|---|---|
| 3,194,772 | 7/1965 | Trotz | 260/2 |
| 3,425,999 | 2/1969 | Axeir | 528/76 |
| 3,577,559 | 5/1971 | Horsley | 260/410.6 |
| 3,834,935 | 9/1974 | Symm et al. | 428/361 |
| 3,963,628 | 6/1976 | Park | 252/8.9 X |
| 4,027,346 | 6/1977 | Wada et al. | 8/115.6 X |
| 4,038,296 | 7/1977 | Greif et al. | 252/8.9 X |
| 4,094,797 | 6/1978 | Newkirk et al. | 252/8.9 |
| 4,110,227 | 8/1978 | Newkirk et al. | 252/8.9 |

FOREIGN PATENT DOCUMENTS

| | | |
|---|---|---|
| 52-213 | 1/1977 | Japan . |
| 854958 | 11/1960 | United Kingdom . |

*Primary Examiner*—Michael F. Esposito

*Assistant Examiner*—Thurman K. Page

*Attorney, Agent, or Firm*—Andrew E. Pierce

[57] ABSTRACT

There are disclosed surface lubricants or processing aids for synthetic fibers particularly polyester, polyacrylic, and polyamide (nylon) fibers or mixtures thereof comprising an ethylene oxide capped heteric polymer of tetrahydrofuran (tetramethylene oxide) and ethylene oxide designated as a heteric/block copolymer having the formula:

$$Y\left[(A)_{\overline{N}}-(C_2H_4O)_{\overline{M}}-H\right]_x$$

wherein Y is the residue formed by the removal of x atoms of active hydrogen from an initiator preferably having a total of not more than 20 carbon atoms and free of elements other than carbon, hydrogen, and oxygen, said initiator having 1 to about 5 reactive hydrogen atoms and preferably being selected from the group consisting of water, alkylene glycols, polyalkylene glycols, alkanols, phenols, and alkyl phenols; A is a heteric mixture of ethylene oxide and tetramethylene oxide residues derived from the reaction of ethylene oxide and tetramethylene oxide in the respective ratio by weight of 1:4 to 4:1; x is an integer of 1 to about 5; n is an integer such that the total heteric ethylene oxide-tetramethylene oxide residue weight, n x, is about 90 to about 10 percent by weight of the total oxyalkylene weight of the compound; m is an integer such that the total ethylene oxide residue weight in the cap portion of the compound, m x, is about 10 to about 90 percent, by weight, of the total oxyalkylene weight of the compound; and the total molecular weight of said heteric mixture, n x, is about 500 to about 6000.

7 Claims, No Drawings

FIBER LUBRICANTS BASED UPON ETHYLENE OXIDE CAPPED POLYETHERS OF TETRAHYDROFURAN AND ETHYLENE OXIDE

BACKGROUND OF THE INVENTION

1. Field of the Invention

This invention relates to the processing of multi-filament and mono-filament synthetic fibers particularly polyester and nylon fibers with fiber lubricants which are applied as spin-finishes subsequent to the extrusion of the fibers from the spinneret.

2. Description of the Prior Art

In the production of polyester and polyamide filaments, a lubricant is generally added after extrusion of the fibers. The lubricant is essential in order that the subsequent processing of the emerging filaments can take place. The filaments are often subjected to a false twist process in which the fibers are stretched after being contacted with a heated metal plate. In addition to lubricity properties required to avoid breaking the fibers during such processing, relatively high oxidation stability is required to avoid breakdown of the fiber lubricants upon exposure to the temperatures encountered during the false twist processing operation. A further desirable requirement is improved biodegradeability. Because the lubricants of the invention are straight chain compounds, they have potentially greater biodegradeability than the branched chain 1,2-propylene oxide based fiber lubricants of the prior art.

It is known to utilize polyoxyethylene compounds as fiber lubricants to prevent fiber breakage during false twist processing. Such polyoxyethylene compounds including heteric polyoxyalkylene compounds derived from the random polymerization of polytetramethylene oxide (tetrahydrofuran) with either ethylene oxide or 1,2-propylene oxide and utilizing an acid or alcohol as an initiator are known from Tanizaki et al, Japenese Patent Announcement No. 213-1977. Use of an ethylene oxide cap on a heteric ethylene oxide and tetrahydrofuran copolymer provides a degree of flexibility in the preparation of fiber lubricants that permits more efficient variation of properties including water solubility while maintaining optimum lubricity in the fiber lubricants of the invention.

Polyether polyols prepared by reacting ethylene oxide and tetrahydrofuran are known from U.S. Pat. No. 4,038,296, U.S. Pat. No. 3,425,999 and U.S. Pat. No. 3,194,772.

SUMMARY OF THE INVENTION

It is a primary object of this invention to provide to the art lubricated synthetic fibers and a process therefore wherein said fibers comprise synthetic fibers such as polyester, polyamide, and polyacrylic fibers.

Accordingly, valuable polyether fiber lubricants are obtained by the heteric copolymerization of polytetramethylene glycol with ethylene oxide followed by capping the polymer thus formed with the hydrophilic residue of ethylene oxide. Since water dispersibility or solubility of the polyether is required in a fiber lubricant in addition to lubricity properties, the provision of capping a heteric ethylene oxide-polytetramethylene oxide derived heteric oxyalkylene copolymer with ethylene oxide provides an efficient and easy means to obtain the required water-dispersibility thus allowing the proportion of ethylene oxide to polytetramethylene oxide to be adjusted so as to provide optimum low viscosity, lubricity, and oxidation stability at a given molecular weight of the compound. Thus, a major proportion of the polyether fiber lubricant can contain polytetramethylene moieties for increased oxidation resistance and lubricity as compared with heteric alkoxylates of ethylene oxide and 1,2-propylene oxide copolymers of the prior art and yet provide the required water-dispersibility or solubility in the polyether by the provision of the ethylene oxide cap.

The lubricants of the invention have the formula:

$$Y\text{-}[(A)_n\text{-}(C_2H_4O)_m\text{-}H]_x$$

wherein Y is the residue formed by the removal of x atoms of active hydrogen from an initiator preferably having a total of not more than 20 carbon atoms and free of elements other than carbon, hydrogen, and oxygen, said initiator having 1 to about 5 reactive hydrogen atoms and preferably being selected from the group consisting of water, alkylene glycols, polyalkylene glycols, alkanols, phenols, and alkyl phenols; A is a heteric mixture of oxyethylene and oxytetramethylene residues derived from the reaction of ethylene oxide and tetramethylene oxide in the respective ratio by weight of 1:4 to 4:1; x is an integer of 1 to about 5; n is an integer such that the total ethylene oxide-tetramethylene oxide residue weight, n x, is about 90 to about 10 percent, preferably about 85 to about 25 percent by weight of the total oxyalkylene residue weight; m is an integer such that the total ethylene oxide residue weight in the cap portion of the compound, m x, is about 10 to about 90 percent, preferably about 15 to about 75 percent by weight of the total oxyalkylene residue weight; and the total molecular weight of the said heteric mixture, n x, is about 500 to about 6000, preferably about 1000 to about 4000.

DETAILED DESCRIPTION OF THE INVENTION AND OF THE PREFERRED EMBODIMENTS

As is well known in the prior art, polyether compounds can be produced by first reacting an initiator compound designated as Y in the formula above, said initiator having 1 to 5 active hydrogen atoms. By use of the term "active hydrogen atoms" it is intended to describe any compound which gives a positive Zerewitinoff test. The term active hydrogen atom is well known and clearly understood by those skilled in the art. However, to remove any possible ambiguity in this regard, the term active hydrogen atom, as used herein and in the appended claims, includes any hydrogen atom fulfilling the following two conditions:

(1) It is sufficiently labile to open the epoxide ring of 1,2-propylene oxide, and (2) It reacts with methyl magnesium iodide to liberate methane in the classical Zerewitinoff reaction (see Niederl and Niederl, Micromethods of Quantitative Organic Analysis, P. 263, John Wiley and Sons, New York City, 1946).

Representative examples of such compounds are monohydric alcohols such as phenol, cresol, butanol, 2-ethylhexanol, ethanol, and methanol an polyhydric alcohols such as hydroquinone, ethylene glycol, butylene glycol, diethylene glycol, glycerol, and trimethylolpropane. A wide variety of suitable initiators and general procedures for making polyethers are illustrated, for instance, in U.S. Pat. Nos. 2,674,619 and 2,677,700, incorporated herein by reference.

In utilizing the procedures of the prior art for the preparation of polyethers, the 1,2-propylene oxide used therein is replaced with tetramethylene oxide in making the heteric/block polymers of the invention useful as fiber lubricants. The preferred initiators are those having up to three active hydrogen atoms and one to about eight, most preferably one to about four, carbon atoms.

The polyethers of the invention generally contain a total of about 90 to about 10 percent by weight of the heteric ethylene oxide-polytetramethylene copolymer based upon the total oxyalkylene weight and preferably about 85 to about 25 percent by weight. The proportion of ethylene oxide residue in the hydrophilic cap can vary to the extent required to maintain the desired water solubility or water dispersibility of the fiber lubricants of the invention; the proportion also varying somewhat depending upon the molecular weight of the heteric polytetramethylene oxide-ethylene oxide copolymer. Generally the total ethylene oxide residue weight is about 10 to about 90 percent, by weight, preferably about 15 to about 75 percent by weight based upon the total oxyalkylene weight. Generally the molecular weight of said heteric copolymer is about 500 to about 6000, it being found that the polyether lubricants of the invention have less volatility at elevated temperatures as the molecular weight of said heteric copolymer is increased to the above upper limit. However, high molecular weight polyethers of the invention, in comparison with those prepared with 1,2-propylene oxide substituted for polytetramethylene oxide require either a larger proportion of ethylene oxide in the heteric portion of the copolymer to render the polyether water dispersible or water soluble at ambient temperatures or a larger proportion of ethylene oxide in the cap.

Generally, the ethylene oxide capped heteric ethylene oxide-tetrahydrofuran copolymers of the invention are prepared by first preparing the heteric portion of the polymer by reacting a mixture of tetrahydrofuran and ethylene oxide with a monohydric or polyhydric alcohol in the presence of a Lewis acid catalyst and then reacting the product obtained with ethylene oxide using base catalysis. As is well known to those skilled in the art, a Lewis acid is defined as any molecule or ion that can combine with another molecule or ion by forming a covalent bond with two electrons from the second molecule or ion. A Lewis acid is thus an electron acceptor. Many compounds in addition to the hydrogen ion exhibit this behavior, for instance boron trifluoride and aluminum chloride. The base catalysis reaction of ethylene oxide with the heteric copolymer can use suitable bases including the alkali metal hydroxides such as potassium hydroxide. Further details of the preparation of the heteric portion of the copolymers of the invention can be found in Tanizaki et al as cited above, incorporated herein by reference.

The lubricants of the invention can be applied to the synthetic fibers to be lubricated in any convenient manner, for instance as oils upon dilution with a natural or synthetic oil which is a solvent or diluent for the polyethers of the invention, as waxes by passing the fibers over a block of wax, or as dispersions or solutions in water at ambient temperatures. Since only a very small amount of lubricant is necessary (generally about 0.1 percent by weight to about 1 percent by weight of lubricant being required based upon the weight of the fiber) it is generally most convenient to dilute the lubricant by dissolving or dispersing it in water. The lubricant can then be applied by a spray, immersion or other known prior art techniques. Because the polyether lubricants of the invention are generally stable at the usual temperatures utilized in drawing and crimping synthetic fibers, conventional stabilizers and antioxidants are generally not required. However, where additional stability to oxidation is necessary, suitable additives known in the prior art containing phenolic or aromatic amines group, for instance, Bisphenol A or the antioxidant disclosed in U.S. Pat. No. 3,146,272 can be used.

It is believed that the oxidative deterioration of polyoxyalkylene compounds is accompanied by the formation of carbonyl compounds, peroxides and acids and that the manifestation of such deterioration is often a decrease in viscosity and concordant formation of volatile by-products as indicated by the fuming of the composition at elevated temperature. Thus, the tendency to smoke or fume of polyoxyalkylene textile lubricants upon their use at elevated temperatures such as about 200° C. is commonly utilized as an indicator of oxidation stability of the compound. Thermogravimetric analysis is also commonly used in the laboratory to evaluate oxidation stability of such products. For instance, the oxidative stability of the polyoxyalkylene products of the invention can be evaluated by utilizing a DuPont Model 990 Thermo-Analyzer. In these test procedures, a gas flow rate of 50 milliliters per minute and a rate of heating of 10° C. per minute is utilized.

The molecular weight of the ethylene oxide capped tetrahydrofuran-ethylene oxide polyether heteric copolymer (heteric/block) lubricants of the invention can be calculated from the hydroxyl number in accordance with the formula:

$$\text{Molecular weight} = \frac{56.1 \times 1000 \times \text{number of hydroxyl groups}}{\text{hydroxyl number}}$$

The hydroxyl number of the polyether can be calculated as described in ASTM D-1638.

The following test methods are used in evaluating the lubricity of the fiber lubricants of the instant invention. Lubricity of polyester filament yarn having fiber lubricants of the invention applied thereto is evaluated by applying to a scoured 125-denier, partially-oriented polyester filament producer yarn the desired percentage of lubricant. The lubricant is applied to the yarn utilizing an Atlas Yarn Finish Applicator made by the Precision Machine Development Company in which yarn is passed at a controlled speed through a continually replenished drop of finish solution of specified strength in order to achieve a uniform wetting of the yarn. The solution is metered using a syringe pump. The yarn during treatment is passed from a feeder globule over an adjustable canter roller which functions to space the yarn filaments for passage over a drying drum utilized in conjunction with the application of heat in the application of the fiber lubricant to the yarn. The yarn finally is passed over a winding tube and is subsequently conditioned overnight under controlled conditions of temperature and humidity (65 percent relative humidity and 70° F.) before being tested. Utilizing the fiber lubricant treated yarn, the coefficient of friction (f) is determined using a Rothschild F-Meter in which the yarn is passed over a 0.313 diameter satin chrome pin at a contact angle of 180° and at a speed of 50, 100, 150, 200, 250, and, wherever possible, 300 meters per minute. Tensiometers on the Rothschild machine measure the yarn tension before and after it passes over the friction pin so as to insure uniformity of conditions. The input tension is maintained at a value of 12 grams by use of a controlling drum. The coefficient of friction is determined directly from the instrument chart. For comparison, the polyester filament yarn is measured for lubricity prior to treatment with the fiber lubricant of the invention and after being treated with prior art lubricants.

The following examples illustrate the preparation of the fiber lubricants of the invention. Where not otherwise specified throughout this specification and claims, temperatures are given in degrees centrigrade and parts, percentages, and proportions are by weight.

EXAMPLE 1

The ethylene oxide capped heteric copolymer fiber lubricants of the invention were prepared by first preparing heteric copolymers in the presence of a Lewis acid catalyst. Generally, the preparation of the heteric copolymer is as follows: To a round bottom flask equipped with a stirrer, thermometer, and dry ice condenser which has been flushed with nitrogen, there was added the initiator, tetrahydrofuran and boron trifluoride etherate catalyst. The catalyst concentration used was generally 1.5 mole percent of the hydroxyl source. Where high molecular weight products are made, a solvent such as methylene chloride can be added to retain a fluid reaction product mixture. Ethylene oxide was added to the reaction mixture by the vapor addition method. In this method, the ethylene oxide is vaporized and added to the dry ice condenser where it is allowed to condense and drop into the reaction flask. Ethylene oxide is added at a reaction temperature of between 35° to 40° C. When the ethylene oxide addition is complete, the reaction is stirred for two hours to allow reaction to take place. The reaction is stopped by the addition of sodium bicarbonate and the product obtained is filtered to remove the bicarbonate residue and stripped under vacuum to remove unreacted starting materials or solvent. An ethylene oxide cap is added to the above-obtained heteric copolymer by reacting ethylene oxide with the heteric copolymer in the presence of a base catalyst such as potassium hydroxide.

A tetrahydrofuran:ethylene oxide heteric copolymer was prepared using methanol as an initiator in accordance with the general procedure described above using the following detailed procedure.

To a two liter flask at room temperature, there was added 16 moles (1154 grams) of tetrahydrofuran, two moles (64 grams) of absolute methanol, and 12 grams of boron trifluoride etherate. While continuously stirring this mixture, there was added four moles (176 grams) of ethylene oxide over a period of 47 minutes and the mixture was allowed to react for three hours at a temperature of about 50° C. The reaction mixture was then cooled to about 43° C. and the reaction terminated by the addition of ten grams of sodium bicarbonate. After filtering off the sodium bicarbonate and stripping, a clear filtrate of the heteric copolymer was obtained in the amount of 574 grams.

Utilizing 454 grams of the above-prepared heteric copolymer, the desired fiber lubricant of the invention having a 20 percent by weight ethylene oxide cap was prepared as follows: To 454 grams of the above-prepared heteric copolymer there was added in a one gallon autoclave, five grams of a 45 percent by weight aqueous potassium hydroxide. The autoclave was evacuated to less than ten millimeters of mercury pressure while heating to a temperature of 100 to 110° C. and the mixture was stripped for 30 minutes at this temperature. The vacuum was relieved with nitrogen to a pressure of 3.5 pounds per square inch gauge and then the mixture was heated to 135° C. and the autoclave pressurized with nitrogen to 34 pounds per square inch gauge. Ethylene oxide was then added in the amount of 114 grams at the rate of 50 to 100 grams per hour. When the addition of ethylene oxide was complete, the mixture was reacted at 100 to 110° C. for a period of two hours and then cooled to 80° C. and the autoclave vented and the product discharged. The product obtained had a molecular weight of 361 and contained a total of 43 percent by weight of ethylene oxide in the product.

EXAMPLE 2

Following the procedure of Example 1, an ethylene oxide capped heteric copolymer of ethylene oxide and tetrahydrofuran having a 20 percent by weight ethylene oxide cap and a molecular weight of 770 was prepared by first preparing a heteric copolymer using the following proportions of ingredients: tetrahydrofuran, 16 moles; absolute methanol, 1 mole; boron trifluoride etherate, 12 grams; and ethylene oxide, 4 moles. The product obtained was a clear filtrate weighing 773 grams.

The ethylene oxide capped heteric copolymer fiber lubricant of the invention was then prepared utilizing 600 grams of the heteric copolymer prepared above, 6.7 grams of a 45 percent by weight aqueous solution of potassium hydroxide and 150 grams of ethylene oxide. The product obtained had a molecular weight of 770 and a total of 37 percent by weight of ethylene oxide in the product.

EXAMPLES 3 & 4

Examples 1 and 2 are repeated except that instead of methanol as an initiator there are used respectively butanol and 2-ethylhexanol to obtain the ethylene oxide capped heteric copolymers of ethylene oxide and tetrahydrofuran fiber lubricants of the invention.

While this invention has been described with reference to certain specific embodiments, it will be recognized by those skilled in the art that many variations are possible without departing from the spirit and scope of the invention and it will be understood that it is intended to cover all changes and modifications of the invention disclosed herein for the purposes of illustration which do not constitute departures from the spirit and scope of the invention.

The embodiments of the invention in which an exclusive property or privilege is claimed are defined as follows:

1. A lubricated synthetic textile fiber comprising a polyester, polyamide, or polyacrylic fiber, or mixtures thereof and present on the surface thereof a lubricating amount of an oxyalkylene compound of the formula $$Y\left[(A)_m-(C_2H_4O)_m-H\right]_x$$

wherein Y is the residue formed by the removal of x atoms of active hydrogen from an initiator having a total of not more than 20 carbon atoms and free of elements other than carbon, hydrogen, and oxygen; A is a heteric mixture of ethylene oxide and tetrahydrofuran residues derived from the reaction of ethylene oxide and tetrahydrofuran in the respective ratio by weight of 1:4 to 4:1; x is an integer of 1 to about 5; n is an integer such that the total heteric ethylene oxide-tetrahydrofuran residue weight, n x, is about 90 to about 10 percent by weight of the total oxyalkylene weight of the compound; m is an integer such that the total ethylene oxide residue weight in the cap portion of the compound, m x, is about 10 to about 90 percent by weight of the total oxyalkylene weight of the compound; and the total molecular weight of the said heteric mixture, n x, is about 500 to about 6000.

2. The composition of claim 1 wherein said initiator is selected from the group consisting of water, alkylene glycols, polyalkylene glycols, alkanols, phenols, and alkyl phenols.

3. The composition of claim 1 wherein said initiator is the residue of a $C_1$–$C_4$ monoalcohol.

4. The composition of claim 3 wherein said monoalcohol is selected from the group consisting of butanol and 2-ethylhexanol.

5. In a process for lubricating synthetic textile fibers with a polyether fiber lubricant, the improvement wherein a polyether is applied to said fibers from an aqueous dispersion wherein said polyether is a compound having the formula:

$$Y\text{-}[(A)_n\text{—}(C_2H_4O)_m\text{—}H]_x$$

wherein Y is the residue formed by the removal of x atoms of active hydrogen from an initiator having a total of not more than 20 carbon atoms and free of elements other than carbon, hydrogen, and oxygen; A is a heteric mixture of ethylene oxide and tetrahydrofuran residues derived from the reaction of ethylene oxide and tetrahydrofuran oxide in the respective ratio by weight of 1:4 to 4:1; x is an integer of 1 to about 5; n is an integer such that the total ethylene oxide-tetrahydrofuran residue content, n x, is about 90 to about 10 percent by weight of the total oxyalkylene weight; m is an integer such that the total ethylene oxide residue weight of the cap portion of the compound, m x, is about 10 to about 90 percent by weight of the total oxyalkylene weight; and the total molecular weight of said heteric mixture, n x, is about 500 to about 6000.

6. The process of claim 5 wherein said initiator is selected from the group consisting of water, alkylene glycols, polyalkylene glycols, alkanols, phenols, and alkyl phenols.

7. The process of claim 6 wherein said synthetic fibers are selected from the group consisting of polyester, polyamide, and polyacrylic fibers.

* * * * *